US009957093B2

(12) United States Patent
Olsen

(10) Patent No.: US 9,957,093 B2
(45) Date of Patent: May 1, 2018

(54) CONTAINER PACKAGE

(71) Applicant: Robert C. Olsen, Medinah, IL (US)

(72) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 616 days.

(21) Appl. No.: 13/801,738

(22) Filed: Mar. 13, 2013

(65) Prior Publication Data

US 2014/0110294 A1 Apr. 24, 2014

Related U.S. Application Data

(60) Provisional application No. 61/715,417, filed on Oct. 18, 2012.

(51) Int. Cl.
*B65D 75/00* (2006.01)
*B65D 71/50* (2006.01)

(52) U.S. Cl.
CPC ..... *B65D 71/504* (2013.01)

(58) Field of Classification Search
USPC ..... 206/216, 217, 218, 223, 541, 548, 549, 206/150, 151, 431
See application file for complete search history.

(56) References Cited

U.S. PATENT DOCUMENTS 3,829,143 A * 8/1974 Bird ..... 294/31.2
3,913,738 A 10/1975 Olsen
4,109,787 A * 8/1978 Klygis et al. ..... 206/150
5,060,999 A * 10/1991 Marvin ..... 294/87.2
5,098,144 A * 3/1992 Marvin ..... 294/87.2
5,135,104 A * 8/1992 Jorba ..... 206/151
5,441,148 A * 8/1995 Appleton ..... 206/150
5,456,350 A * 10/1995 Olsen et al. ..... 206/150
5,456,351 A * 10/1995 Johnson ..... 206/217
5,518,117 A * 5/1996 Eriksen ..... 206/431
5,593,026 A * 1/1997 Broskow ..... 206/150
5,682,996 A * 11/1997 Le Bras ..... 206/429
5,927,502 A * 7/1999 Hunter ..... 206/549
6,068,127 A * 5/2000 Hunter ..... 206/549
6,170,652 B1 * 1/2001 Olsen ..... 206/150
6,183,027 B1 * 2/2001 Tsao ..... 294/146
6,230,880 B1 * 5/2001 Marco et al. ..... 206/150
6,551,639 B1 * 4/2003 Nye et al. ..... 426/117
7,237,671 B2 * 7/2007 Chambers et al. ..... 206/150
8,313,132 B2 * 11/2012 Kuzma et al. ..... 294/159
8,418,844 B2 * 4/2013 Slaters et al. ..... 206/150
2003/0209454 A1 * 11/2003 Hunter ..... 206/217
2004/0011688 A1 * 1/2004 Ishikawa ..... 206/431
2004/0045854 A1 * 3/2004 Bergerioux et al. ..... 206/431
2004/0134799 A1 * 7/2004 Mattson et al. ..... 206/150
(Continued)

FOREIGN PATENT DOCUMENTS

EP 2 301 858 A1 3/2011
FR 2 791 958 10/2000
GB 2475622 A 5/2011

*Primary Examiner* — Jacob K Ackun
(74) *Attorney, Agent, or Firm* — Pauley Erickson & Kottis

(57) ABSTRACT

A flexible carrier for carrying a plurality of containers within a plurality of corresponding container receiving apertures wherein each container receiving aperture is stretched around a perimeter of a corresponding container and positioned under a flap extending downward from the corresponding container.

6 Claims, 2 Drawing Sheets

(56) References Cited

U.S. PATENT DOCUMENTS

| | | | | |
|---|---|---|---|---|
| 2006/0157376 | A1* | 7/2006 | Hortel | 206/549 |
| 2006/0289315 | A1* | 12/2006 | Olsen | 206/150 |
| 2008/0203204 | A1* | 8/2008 | Olsen | 242/160.1 |
| 2008/0230405 | A1* | 9/2008 | Olsen | 206/150 |
| 2009/0101662 | A1* | 4/2009 | Marco et al. | 220/737 |
| 2009/0230083 | A1* | 9/2009 | Metcalfe et al. | 215/395 |

* cited by examiner

CONTAINER PACKAGE

CROSS REFERENCE TO RELATED APPLICATION

This application claims the benefit of U.S. Provisional Application No. 61/715,417, filed 18 Oct. 2012.

BACKGROUND OF THE INVENTION

Field of the Invention

This invention relates to a flexible carrier for carrying a plurality of flexible containers such as cartons in a unitized package.

Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Flexible ring carriers may include a handle that extend upwardly from the carrier to enable a consumer to carry the package.

Typically, flexible ring carriers are used to unitize a plurality of generally rigid containers, like cans or bottles. Flexible packaging, such as soft sided juice boxes and similar bags are generally placed into boxes or similar rigid containers. However, a need exists to unitize a plurality of such soft and/or flexible containers into a pleasing consumer package that openly displays the packages and minimizes packaging waste.

SUMMARY OF THE INVENTION

The present invention is directed to a flexible carrier for packaging flexible containers that includes an array of container receiving apertures arranged preferably in two rows of generally rectangular apertures. According to preferred embodiments of this invention, each container receiving aperture receives a container and engages the container under or along a sealed flap, to form a package. In addition, a handle is preferably connected, either along an edge or between the rows of container receiving apertures.

The resulting carrier is configured to permit each container receiving aperture to engage a respective carrier both with an encircling band and an edge of the band with the flap.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
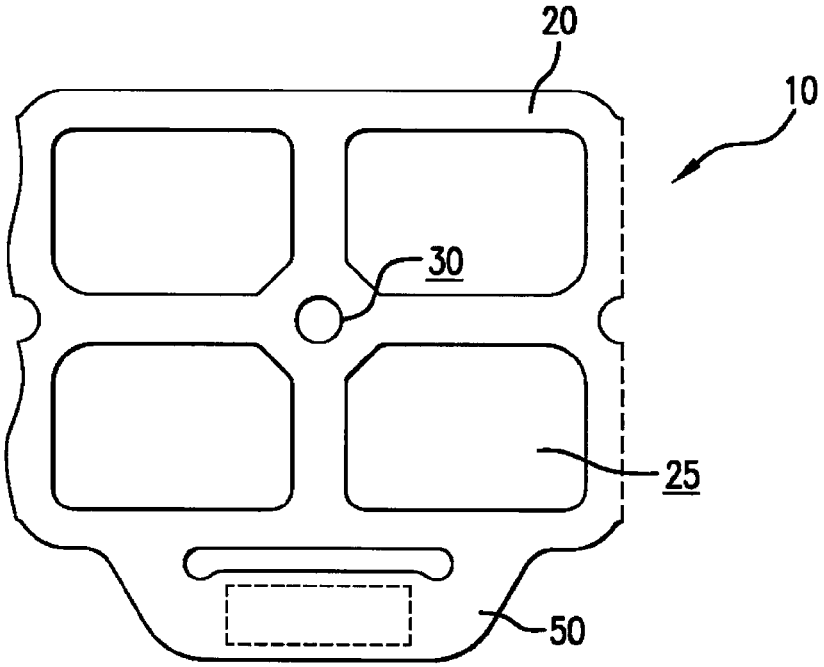
FIG. 1 is a side elevational view of a flexible carrier according to one preferred embodiment of this invention.
Figure 2:
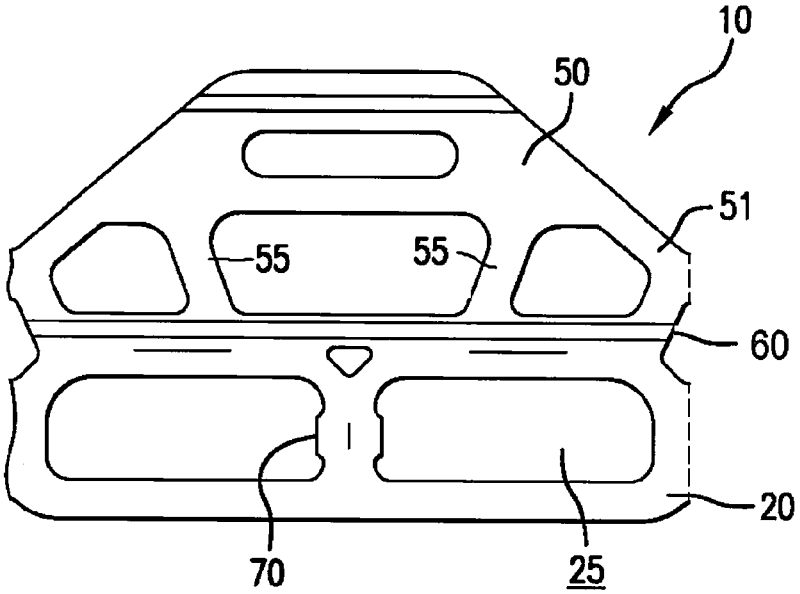
FIG. 2 is a side elevational view of a flexible carrier according to one preferred embodiment.
Figure 3:
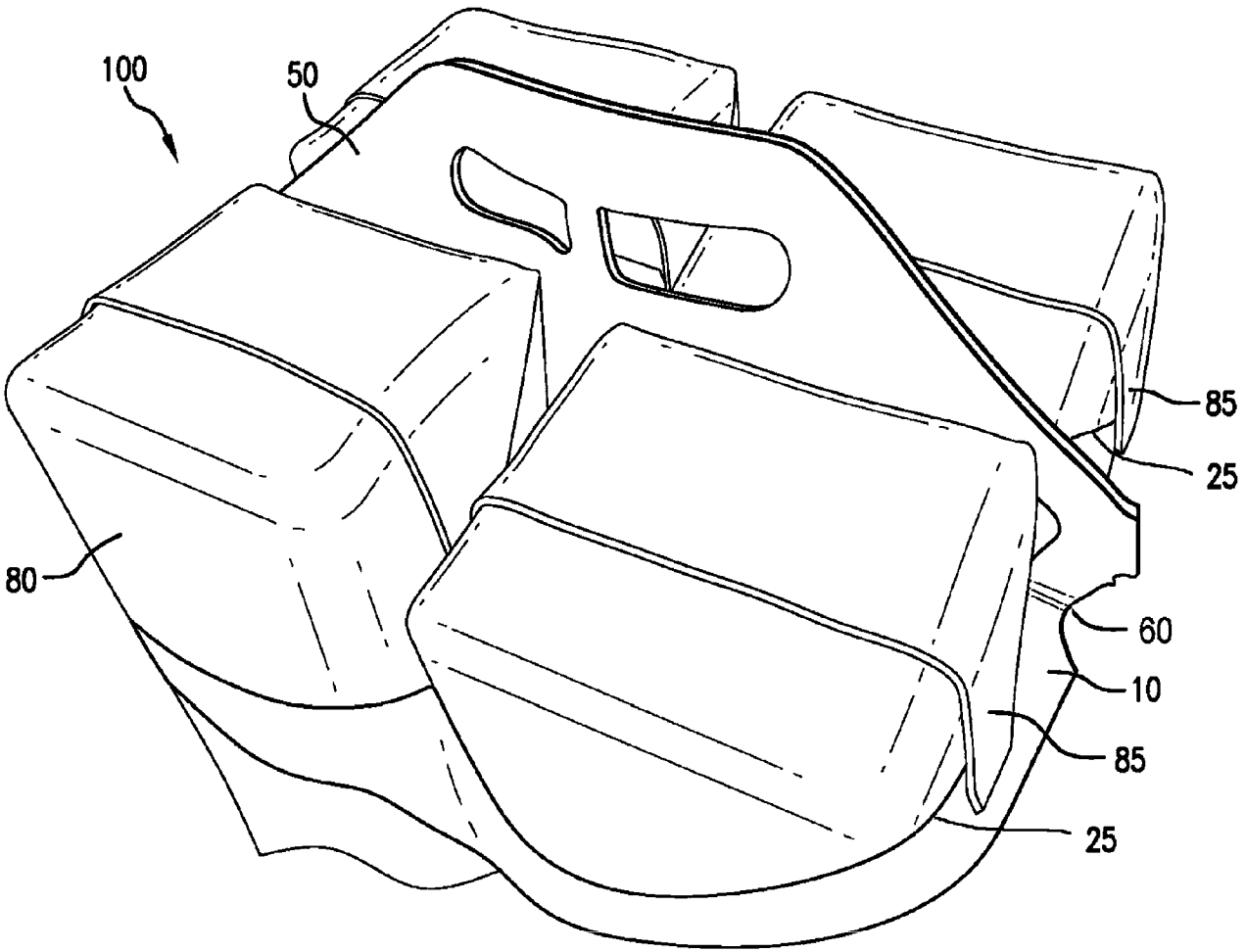
FIG. 3 is a side perspective view of a package of containers, using the carrier shown in FIG. 2, according to one preferred embodiment of this invention.

FIGS. 1-3 show a flexible carrier 10 for a plurality of flexible containers and a resulting unitized package. Although FIGS. 1-3 illustrate various structures for the flexible carrier 10 of the invention, the illustrations are exemplary, and the invention is not limited to the flexible carriers 10 or packages shown. For example, the flexible carrier 10 may be alternatively configured and used to unitize six, eight or any other desired number of containers 80.

Containers 80, such as those shown in FIG. 3, are preferably soft-sided flexible containers, such as TETRA PAK™ containers however, similar flexible containers or other commonly unitized containers may be used with flexible carrier 10 according to this invention. The containers are preferably, though not necessarily, like-sized within a single flexible carrier 10.

Each flexible carrier 10 preferably includes one or more layers of a flexible sheet 20 having a width and length defining therein a plurality of container receiving apertures 25, each for receiving a container 80. The plurality of container receiving apertures 25 are preferably arranged in longitudinal rows and longitudinal ranks so as to form an array of container receiving apertures 25, such as two rows by two ranks for a four container multipackage as shown in FIGS. 1 and 2. The container receiving apertures 25 are preferably generally square, as shown in FIG. 1, or elongated in a longitudinal direction of flexible carrier 10, as shown in FIG. 2.

According to one preferred embodiment of this invention, such as shown in FIG. 1, a single layer of flexible sheet 20 includes an arrangement of container receiving apertures 25 and a circular void 30 centered within each group of four container receiving apertures 25. In addition, a handle 50 preferably extends from one edge of the flexible sheet 20. In this manner, the assembled package 100 is a "side-lift" package. As shown, the carrier 10 in FIG. 1 comprises only a single layer of flexible sheet 20.

According to one preferred embodiment of this invention, such as shown in FIGS. 2 and 3, two layers of flexible sheet 20 form the carrier 10 wherein the two layers of flexible sheet 20 are connected at least along a longitudinally extending centerline 60. Centerline 60 as used herein generally describes a segment between rows of container receiving apertures 25 and/or between layers of flexible sheet 20. According to one preferred embodiment of this invention, centerline 60 comprises a weld that joins the two layers of flexible sheet 20. The two layers of flexible sheet 20 may be coextruded, welded, or otherwise joined together to create flexible carrier 10. A "weld" as used in the specification and claims may be defined as a hot weld, cold weld, lamination or any other manner of connection that joins two sheets of material known to those having ordinary skill in the art. One or more additional welds may similarly be formed between the two layers of flexible sheet 20 to ensure a reliable carrier 10.

As shown in FIG. 2, a row of container receiving apertures 25 is preferably formed on each side of centerline 60 and/or in each layer of the two layers of flexible sheet 20. As such, one row of container receiving apertures 25 is preferably formed along each side of the centerline 60. Accordingly, four container receiving apertures 25 are formed in flexible carrier 10 shown in FIG. 2, i.e. two overlapping rows of two container receiving apertures 25 each. Container receiving apertures 25 are preferably formed in a geometry that results in a tight unitization of containers 80 without excess play and/or sliding between and among containers 80 and flexible carrier 10. According to this preferred embodiment a handle 50 extends from the centerline 60 or weld. In addition, a plurality of struts 55 are preferably formed between the handle 50 and the centerline 60.

As a result of the described configuration in one preferred embodiment of this invention, two layers of flexible sheet 20 joined with the longitudinally extending centerline 60 include a row of container receiving apertures 25 formed in each layer of the two layers of flexible sheet 20. One row of container receiving apertures 25 is formed on each side of centerline 60 resulting in flexible carrier 10 fanning out at centerline 60 to permit a generally flat plane of engagement within which containers 80 are inserted. Handle 50 preferably extends in a different plane from flexible sheet 20 in this configuration at application, as best shown in FIG. 3. In this manner, each row of container receiving apertures 25 engages a respective row of containers 80 to form package 100.

The package 100 of flexible containers 80 shown in FIG. 3 preferably comprises the carrier 10 for unitizing the plurality of containers 80 within the plurality of corresponding container receiving apertures 25 that includes at least two rows forming a plurality of container receiving apertures. The plurality of containers 80 as described herein are preferably flexible containers wherein each flexible container 80 includes at least one flap 85 extending from a top edge. Each flexible container 80 is preferably engaged within a corresponding container receiving aperture 25 that is thereby positioned under the at least one flap 85. In this manner each container receiving aperture 25 is stretched around a perimeter of a corresponding container 80 and positioned under the flap 85 preferably extending downward from the corresponding container 80.

According to one preferred embodiment of this invention, shown in FIG. 2, the carrier 10 may further include a lip 70 formed along each inner transverse edge of each container receiving aperture 25. The lip 70 preferably assists in properly spacing the flexible containers 80.

As shown in FIG. 3, the package 100 resulting from flexible carrier 10 includes a plurality of unitized flexible containers 80. Flexible carriers 10 are generally applied to containers 80 by stretching the flexible sheet 20 surrounding container receiving apertures 25 around containers 80, and requiring the stretched carrier 10 to recover, thereby providing a tight engagement. According to a preferred embodiment of this invention, the containers 80 include preferably square or rectangular perimeters.

While in the foregoing specification this invention has been described in relation to certain preferred embodiments thereof, and many details have been set forth for purpose of illustration, it will be apparent to those skilled in the art that flexible carrier 10 and package 100 are susceptible to additional embodiments and that certain of the details described herein can be varied considerably without departing from the basic principles of the invention.

The invention claimed is:

1. A package of flexible containers comprising:

a carrier for unitizing a plurality of containers within a plurality of corresponding container receiving apertures that includes a flexible sheet forming at least two rows forming a plurality of container receiving apertures;

a lip formed of the flexible sheet along each inner transverse edge of, and extending into, each container receiving aperture;

a plurality of flexible containers, each flexible container including at least one flap extending downward from a top edge, each flexible container engaged within a corresponding container receiving aperture and the corresponding container receiving aperture positioned under the at least one flap; and a weld positioned between the rows of container receiving apertures.

2. The carrier of claim 1 further comprising a handle extending from the weld.

3. The carrier of claim 2 further comprising a plurality of struts formed between the handle and the weld.

4. A package of flexible containers comprising:

a carrier for unitizing a plurality of containers within a plurality of corresponding container receiving apertures that includes a flexible sheet forming at least two rows forming a plurality of container receiving apertures, wherein each container receiving aperture is generally square;

a lip formed of the flexible sheet along each inner transverse edge of, and extending into, each container receiving aperture;

a plurality of flexible containers, each flexible container including at least one flap extending downward from a top edge, each flexible container engaged within a corresponding container receiving aperture and the corresponding container receiving aperture positioned under the at least one flap; and a circular void formed at a central intersection of each four container receiving apertures.

5. A unitized package of a plurality of containers within a plurality of corresponding container receiving apertures, the package comprising:

a flexible sheet forming a row of container receiving apertures wherein each container receiving aperture is stretched around a perimeter of a corresponding container and a portion of the flexible sheet is positioned under a flap folded downward from the corresponding container.

6. The carrier of claim 5 wherein the flap extends downward from a top edge of the container.

* * * * *